US011780110B1

(12) United States Patent
Collier

(10) Patent No.: US 11,780,110 B1
(45) Date of Patent: Oct. 10, 2023

(54) SAWMILL

(71) Applicant: Charles R. Collier, Kingston, TN (US)

(72) Inventor: Charles R. Collier, Kingston, TN (US)

( * ) Notice: Subject to any disclaimer, the term of this patent is extended or adjusted under 35 U.S.C. 154(b) by 0 days.

(21) Appl. No.: 18/351,316

(22) Filed: Jul. 12, 2023

(51) Int. Cl.
*B27B 31/06* (2006.01)
*B27B 31/00* (2006.01)
*B27B 31/08* (2006.01)

(52) U.S. Cl.
CPC ..... *B27B 31/06* (2013.01); *B27B 31/006* (2013.01); *B27B 31/08* (2013.01)

(58) Field of Classification Search
CPC ..... B27B 13/00; B27B 15/02; B27B 29/08; B27B 29/085; B27B 31/006; B27B 31/04; B27B 31/06; B27B 31/08; B27B 15/04; B27B 15/08; B27B 1/005; B27B 13/04; B27B 25/00; B27B 25/04; B27B 25/08
See application file for complete search history.

(56) References Cited

U.S. PATENT DOCUMENTS

| | | | | |
|---|---|---|---|---|
| 723,470 A | | 3/1903 | Killam | |
| 2,870,803 A | * | 1/1959 | Eppler | B27B 1/005 144/136.7 |
| 3,062,249 A | | 11/1962 | Gray | |
| 4,262,572 A | * | 4/1981 | Flodin | B27B 31/06 144/376 |
| 4,334,669 A | * | 6/1982 | Ross | B27B 15/02 83/794 |
| 4,589,320 A | * | 5/1986 | Kaster | B27B 15/02 83/730 |
| 4,665,786 A | * | 5/1987 | Shields | B27B 31/06 83/411.7 |
| 5,035,166 A | * | 7/1991 | Carlson | B27B 15/02 144/378 |
| 5,088,363 A | * | 2/1992 | Jones | B27B 31/06 144/357 |
| 5,806,401 A | * | 9/1998 | Rajala | B27B 31/00 144/242.1 |
| 6,105,477 A | * | 8/2000 | Olson | B27B 31/006 83/477.1 |
| 6,267,544 B1 | * | 7/2001 | Neville | B27B 29/00 144/242.1 |
| 11,407,140 B2 | * | 8/2022 | Shellswell | B27B 29/00 |

FOREIGN PATENT DOCUMENTS

| | | | | |
|---|---|---|---|---|
| CA | 1103563 A | * | 6/1981 | B27B 1/00 |
| FR | 2921291 A1 | * | 3/2009 | B27B 15/02 |
| GB | 775814 A | | 5/1957 | |
| JP | 5241307 B2 | | 7/2013 | |

* cited by examiner

*Primary Examiner* — Katrina M Stransky
*Assistant Examiner* — Jared O Brown
(74) *Attorney, Agent, or Firm* — Luedeka Neely Group, PC

(57) ABSTRACT

A sawmill for sawing a log segment in two through the core thereof and a method of sawing a log in half through the core thereof. The sawmill includes a log feed conveyor configured for feeding logs to a band saw and a log positioning rig, the band saw being disposed on a movable carriage of a fixed frame, the band saw being configured for sawing a log from a first end of the log to a distal end of the log. The log positioning rig has a reciprocating cradle having a plurality of spaced-apart cradle segments. The reciprocating cradle is pivotally attached to the fixed frame, and is configured for raising or lowering the first end of the log to align the central core of the log along the length of the log with a blade of the band saw.

14 Claims, 6 Drawing Sheets

SAWMILL

TECHNICAL FIELD

The disclosure is directed to sawmills and in particular to sawmills for sawing through the core of a log to produce two half log sections.

BACKGROUND AND SUMMARY

Logs are cut for making a variety of wood products. The value of the wood products is dependent on the type of wood and the uses thereof. For some products, such as staves for barrels, the yield of wood from a log is particularly critical. A first step for making staves is to saw a two to three foot log in half through the core section of the log. Conventional sawmills use a circular saw to halve a log. However, the circular saws have a rather wide kerf that results in excess loss of the most valuable part of the log, the center core of the log.

During the cutting operation for sawing a log in half using a circular saw, the log must be positioned so that the saw cuts through the center core thereof from one end to the other. However, most logs are not symmetrical from one end to the other and thus the center of a log on one end may not be true of the opposite end of the log resulting in a log that is not cut to yield highest rate of high quality boards. Accordingly, what is needed is a sawmill that ensures that a cut is made through the center core of the log. What is also needed is a sawmill that reduces the size of the kerf.

In view of the foregoing, embodiments of the disclosure provide a sawmill for sawing a log segment in two through the core thereof and a method of sawing a log in half through the core thereof. The sawmill includes a log feed conveyor configured for feeding logs to a band saw and a log positioning rig, the band saw being disposed on a movable carriage of a fixed frame, the band saw being configured for sawing a log from a first end of the log to a distal end of the log. The log positioning rig has a reciprocating cradle having a plurality of spaced-apart cradle segments. The reciprocating cradle is pivotally attached to the fixed frame, and is configured for raising or lowering the first end of the log to align the central core of the log along the length of the log with a blade of the band saw.

In some embodiments, the sawmill includes an actuator attached to a first end of the reciprocating cradle and to the fixed frame, wherein the actuator is configured for raising or lowering the first end of the reciprocating cradle to center the central core of the log with the blade of the band saw.

In some embodiment, the reciprocating cradle further includes a plurality of spaced-apart mechanically operated stop arms disposed within the plurality of spaced-apart cradle segments.

In some embodiments, the reciprocating cradle further includes a plurality of spaced-apart dogs disposed within the spaced-apart cradle segments, wherein the plurality of spaced-apart dogs are configured for holding the log segment during the sawing operation. In other embodiments, a pneumatic operator is provided for each of the plurality of spaced-apart dogs.

In some embodiments, the fixed frame includes a shaft about which the reciprocating cradle pivots.

In some embodiments, the fixed frame includes a plurality of spaced-apart log lifting arms disposed within the plurality of spaced-apart cradle segments. In other embodiments, the plurality of spaced-apart log lifting arms are attached to a shaft configured for rotating conveyor chains on each of the plurality of spaced-apart lifting arms.

In some embodiments, the sawmill includes a laser attached to the fixed frame, wherein the laser is configured for aligning the central core of the log with the blade of the saw.

In some embodiments, there is provided a method for sawing a log segment in half. The method includes providing a sawmill for sawing a log segment in two through a central core thereof. The sawmill includes a log feed conveyor configured for feeding logs to a band saw and log positioning rig. The band saw is disposed on a movable carriage of a fixed frame. The log positioning rig includes a reciprocating cradle having a plurality of spaced-apart cradle segments, wherein the reciprocating cradle is pivotally attached to the fixed frame, and is configured for raising or lowering the first end of the log to align the central core of the log along the length of the log with a blade of the band saw. The log segment is fed to the reciprocating cradle from a feed conveyor and the reciprocating cradle is pivoted to align the center of the heart of the log from one end to the other with the band saw. The log segment is sawed in half from one end to a distal end thereof by moving the band saw on the fixed frame from one end of the log to the distal end of the log. The log halves are then moved from the reciprocating cradle to a receiving conveyor for further processing.

In some embodiments, the sawmill includes a plurality of spaced-apart lifting arms within the plurality of space-apart cradle segments, wherein the spaced-apart lifting arms are attached to a shaft, and wherein the lifting arms are activated to center the log segment on the reciprocating cradle prior to the step of pivoting the reciprocating cradle.

In some embodiments, the step of lifting and moving the log halves from the reciprocating cradle to a receiving conveyor includes activating the plurality of spaced-apart lifting arms.

In some embodiments, the log positioning rig includes an actuator attached to a first end of the reciprocating cradle and to the fixed frame, wherein the actuator is activated to raise or low the first end of the reciprocating cradle to center the central core of the log with the blade of the band saw prior to the sawing step.

In some embodiments, the reciprocating cradle includes a plurality of spaced-apart dogs disposed within the spaced-apart cradle segments, wherein the plurality of spaced-apart dogs are activated to hold the log segment during the sawing step.

A particular advantage of the sawmill described herein is that the sawmill using a band saw provides a much thinner kerf than a conventional circular saw thereby increasing the yield of usable boards. The sawmill also provides the ability to saw straight through the heart of a log with less horsepower than a conventional circular sawmill. Setup of the sawmill is less costly since the sawmill has a much smaller footprint. Operation of the sawmill is easier than operating a conventional circular saw sawmill.

DETAILED DESCRIPTION OF THE EMBODIMENTS

Figure 1:
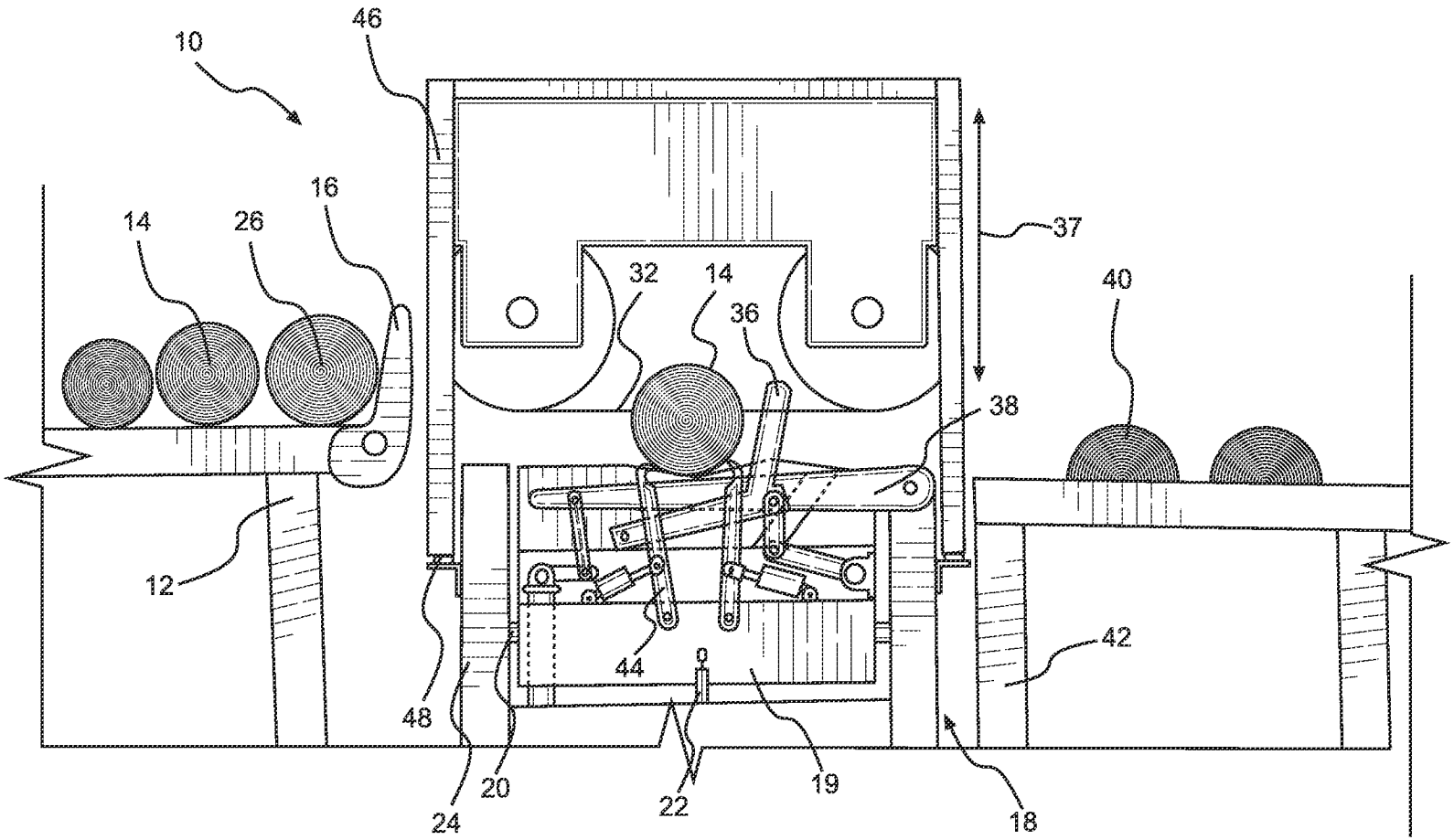
FIG. 1 is an end elevational view, not to scale, of a sawmill according to an embodiment of the disclosure.
Figure 2:
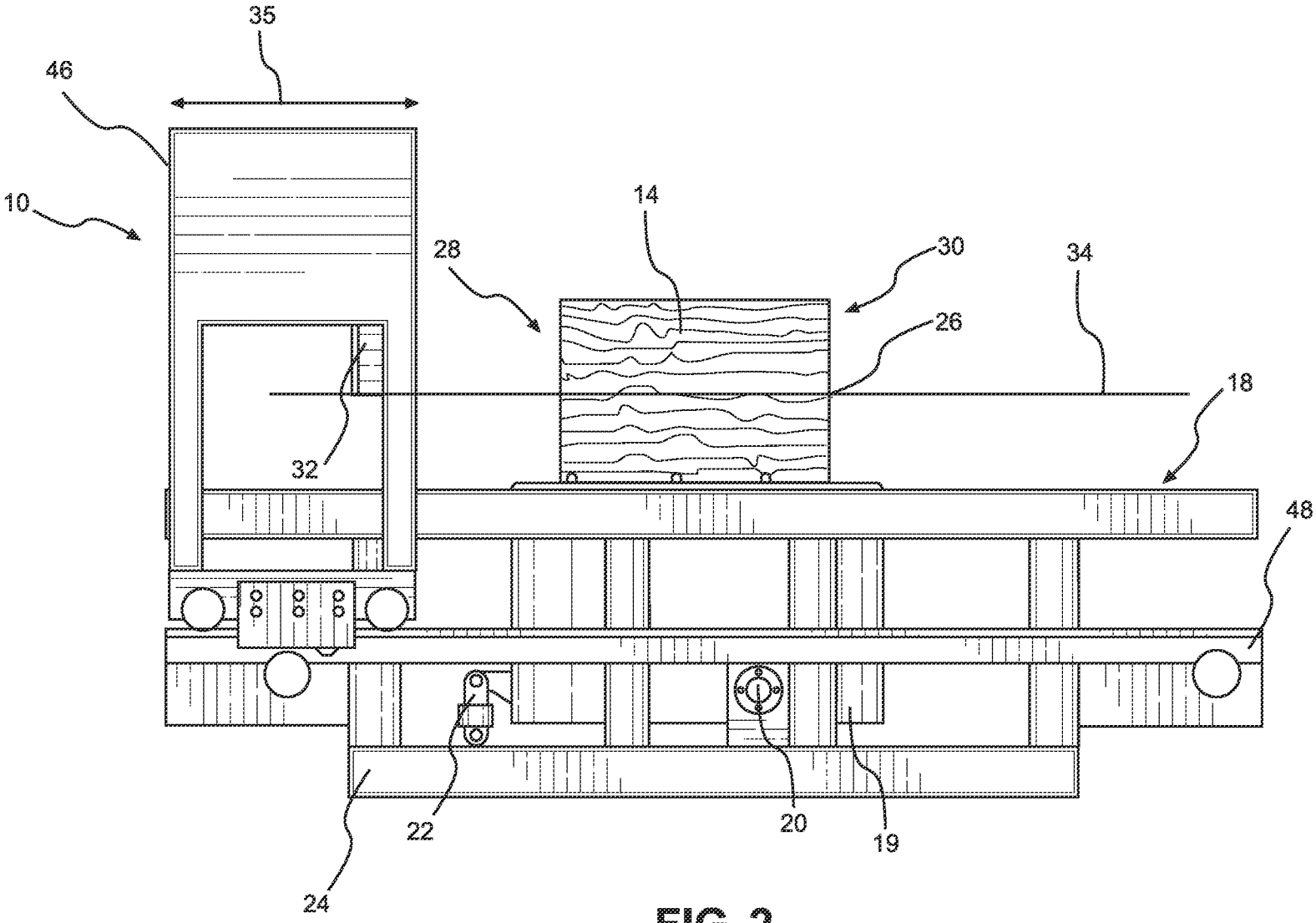
FIG. 2 is a side elevational view, not to scale, of a sawmill of FIG. 1.

With reference to FIGS. 1 and 2, there is illustrated a sawmill 10 according to an embodiment of the disclosure. The sawmill 10 includes a log feed conveyor system 12 configured for feeding log segments 14 to the sawmill 10. The logs segments 14 typically range in length of from about 24 to about 40 inches. In some embodiments, the log segments 14 are used for making barrel staves. However, the sawmill 10 may be designed to cut longer log segments 14 in half for a variety of purposes.

The feed conveyor 12 includes a stop arm 16, that may be manually or automatically operated to feed log segments 14 one at a time to a log positioning rig 18 that includes a reciprocating cradle 19 and a fixed frame 24. The reciprocating cradle 19 is attached by means of a shaft 20 and a tilt control actuator 22 to the frame 24. The tilt control actuator 22 may be pneumatic, hydraulic, or solenoid activated to adjust the reciprocating cradle 19 so that the central core 26 of the log segment 14 is aligned from a first end 28 to a distal end 30 of the log with a blade 32 of a band saw so that the blade 32 of the band saw passes through the central core 26 of the log segment 14 along axis 34 from a first end 28 to a distal end 30 of the log segment 14. A laser or other means (not shown) may be used to align the central core 26 of the log segment 14 with the axis 34 once the log segment 14 is positioned on the reciprocating cradle 18.

As the log segments 14 are fed to the log positioning rig 18, a plurality of log stop arms 36 may be mechanically activated to keep the log segment 14 from rolling past a central position on the reciprocating cradle 19. A plurality of log lifting arms 38, are also attached to the fixed frame 24 and may be activated to rotate the log segment 14, if needed, on the log positioning rig 18 and to remove the cut log halves 40 to a receiving conveyor 42 for further processing. Once the log segment 14 is in position for cutting a plurality of dogs 44 are activated to hold the log segment 14 in position for cutting with the band saw. The band saw is attached to a trolley 46 that rolls on a rail 48 of the fixed frame 24 in the direction of arrow 35 to cut the log segment 14 from the first end 28 to the distal end 30 thereof as shown in more detail in FIG. 2. The band saw may also be configured to move up and down vertically in the direction of arrow 37 in order to align the saw blade 32 with the central core 26 of the log segment 14.

Figure 3:
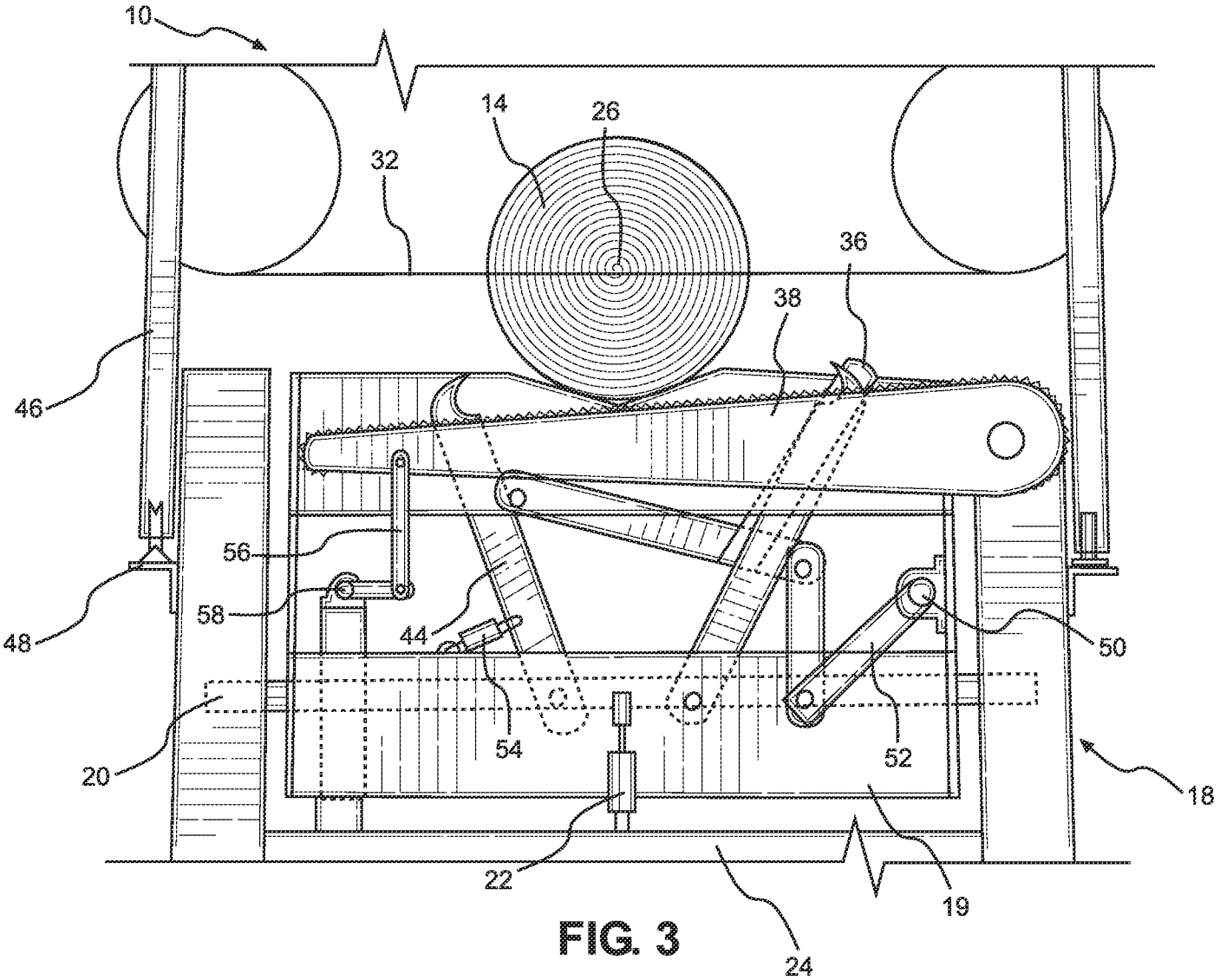
FIG. 3 is an end elevational view, not to scale, of the band saw and log positioning rig within a fixed frame.
Figure 4:
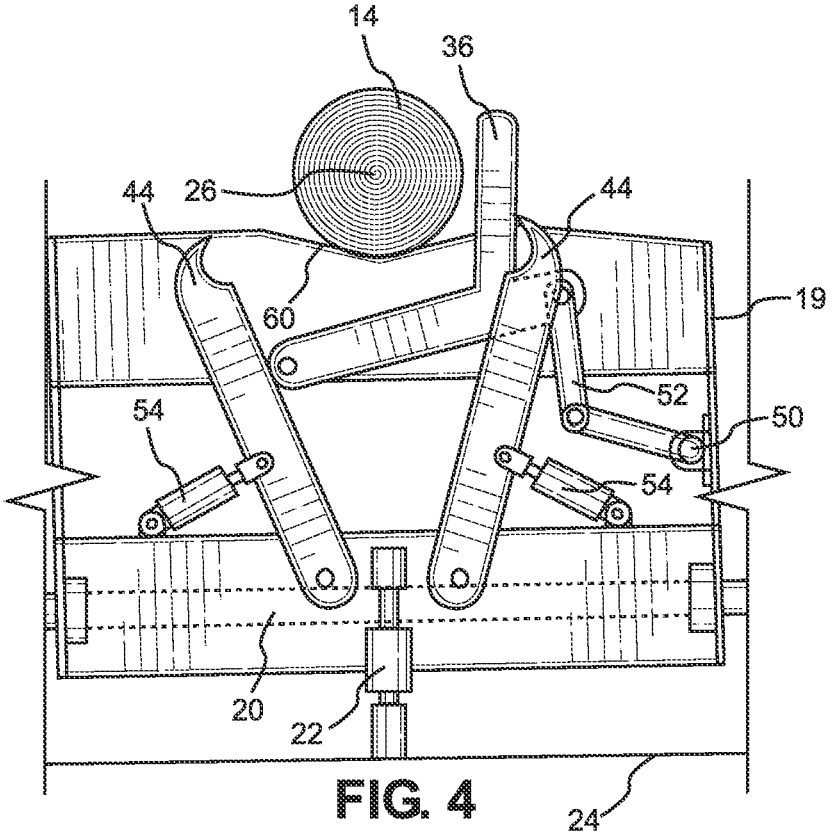
FIGS. 4-5 are end elevational views, not to scale, illustrating the mechanisms for stopping a log segment and holding the log segment for cutting.
Figure 5:
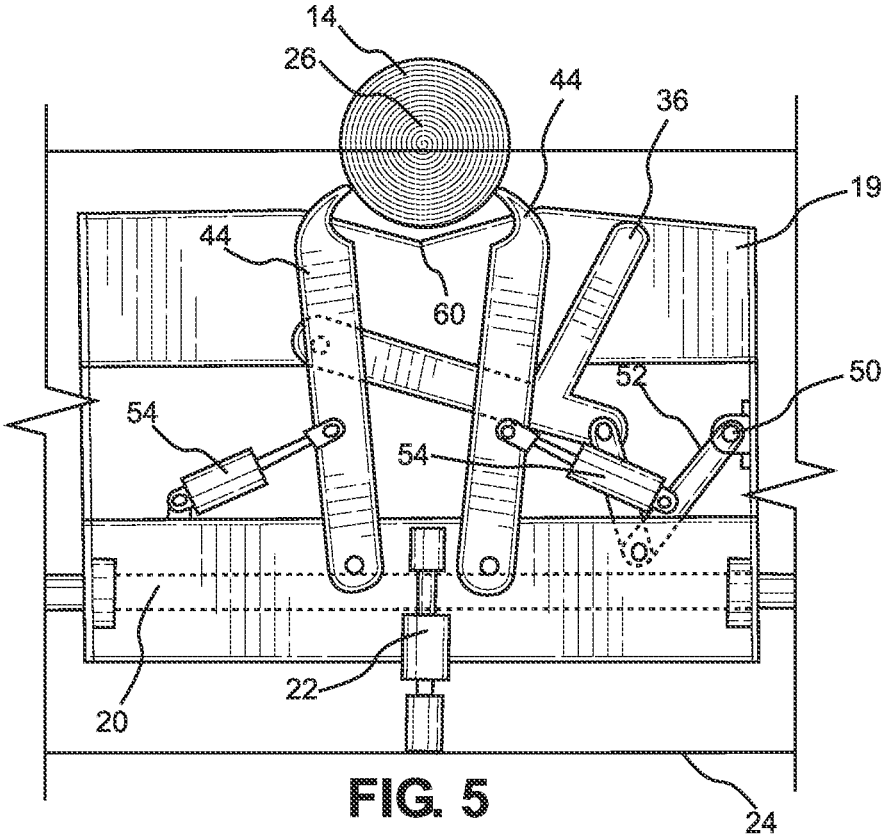

Operational aspects of the log positioning rig 18 may be seen in more detail in FIG. 3. A motor operated shaft 50 may be used with linkages 52 attached to the plurality of log segment stop arms 36 to raise and lower the log segment stop arms 36. Likewise actuators 54 that may be pneumatic or hydraulic cylinders or solenoids 54 may be used to activate the plurality of dogs 44 to hold the log segments 14 in position on the reciprocating cradle 19 for cutting as shown in FIGS. 4 and 5. Once the log segment 14 is cut, linkages 56 on a rotating shaft 58 may be used to raise and lower the plurality of log lifting arms 38.

FIGS. 4-5 illustrate the movement of the plurality of log segment stop arms 36 and the plurality of dogs 44 for holding the log segment 14 during a sawing operation. In FIG. 4, the log segment 14 is rolled onto a central recessed portion 60 of the reciprocating cradle 19 and the plurality of log segment stop arms 36 are activated by rotating shaft 50 through linkages 52 to raise the plurality of log segment stop arms 36 to prevent the log segment 14 from rolling past the central recessed position 60 of the reciprocating cradle 19. In FIG. 4, the dogs 44 are in an open position so as to not interfere with positioning the log segment 14 properly in the recessed portion 60 of the reciprocating cradle 19. In FIG. 5, the shaft 50 is rotated in an opposite direction from FIG. 4 to lower the plurality of log segment stop arms 36. In order to hold the log segment 14 in position for cutting, actuators 54 are activated to rotate the dogs 44 in position to hold the log segment 14 for cutting.

Figure 6:
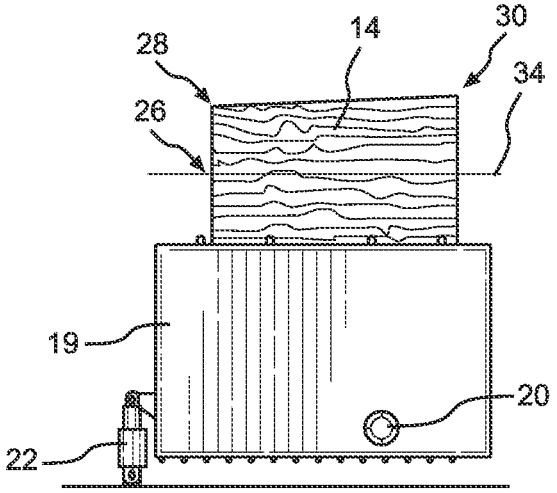
FIGS. 6-8 are somewhat schematic views of the operation of the log positioning rig according to embodiments of the disclosure.
Figure 7:
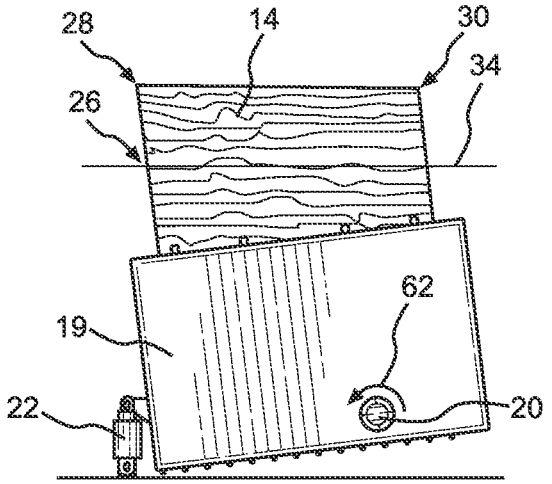
Figure 8:
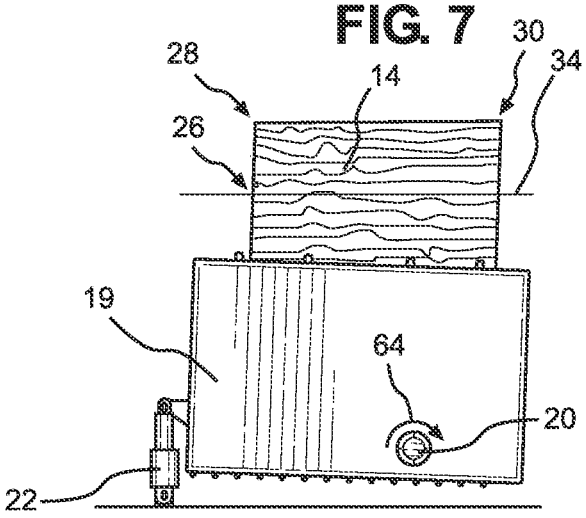
Figure 9:
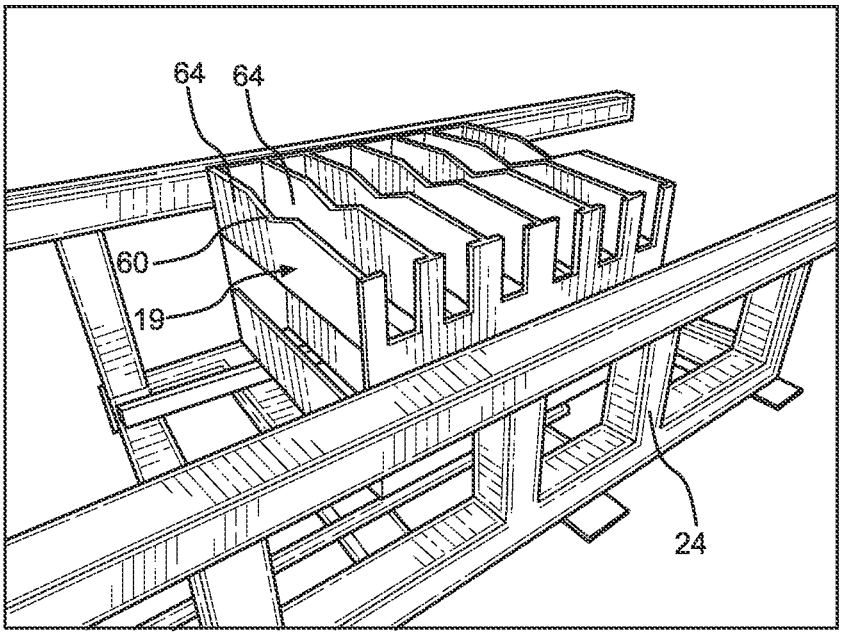
FIG. 9 is a perspective view of portions of the log positioning rig according to an embodiment of the disclosure.
Figure 10:
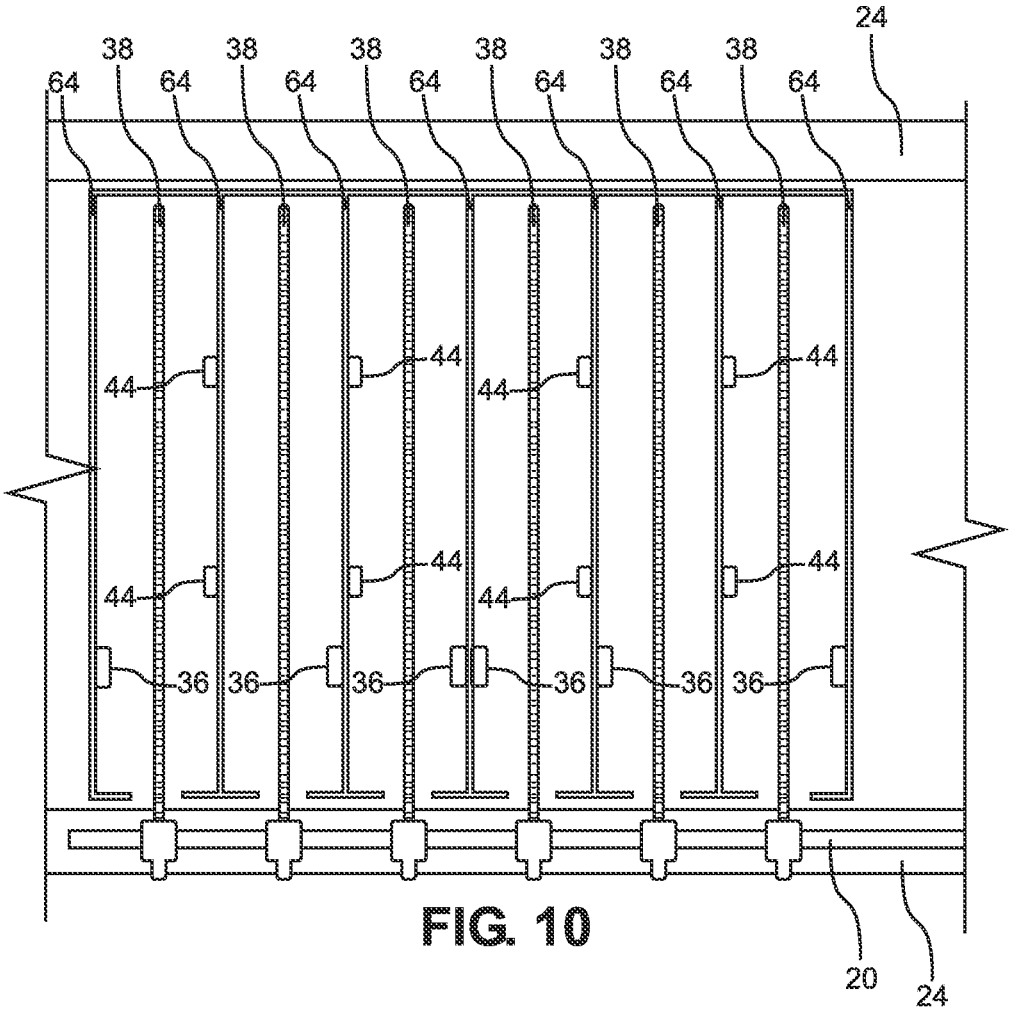
FIG. 10 is a top plan view, not to scale, of the log positioning rig according to an embodiment of the disclosure.

Once the log segment 14 is held in position for cutting, the tilt control actuator 22 may be activated to position the central core 26 of the log segment 14 so that the central core 26 from the first end 28 to the distal end 30 is substantially parallel to the axis 34 (described above). In FIG. 6, the central core 26 of the log segment is substantially parallel to the axis 34 so no rotation of the reciprocating cradle 19 about shaft 20 is required. In FIG. 7, the first end 28 of the log segment 14 has a greater diameter than the second end 30 of the log segment 14 so that the log reciprocating cradle 19 must be rotated counterclockwise in the direction of arrow 62 by the tilt control actuator 22 in order to align the central core 26 of the log segment 14 parallel to axis 34 for cutting through the log segment central core 26. In FIG. 8, the first end 28 of the log segment 14 has a smaller diameter than the second end 30 of the log segment 14 so that the reciprocating cradle 19 must be rotated clockwise in the direction of arrow 64 by the tilt control actuator 22 in order to align the central core 26 of the log segment 14 parallel to axis 34 for cutting through the log segment central core 26. FIG. 9 is a perspective view of portions of the log positioning rig 18 showing the reciprocating cradle 19, the spaced-apart cradle segments 64 and the fixed frame 24. FIG. 10 is a top plan view of the reciprocating cradle 19 disposed within the fixed frame 24 showing the plurality of log segment stop arms 36, plurality of log lifting arms 38, plurality of dogs 44, and plurality of spaced-apart cradle segments 64.

After cutting each log segment 14 in half, the cut log segment 14 is lifted off of the log positioning rig 18 by the plurality of log lifting arms 38 which also act as a conveyor to move the log halves onto the receiving conveyor 42 for further processing. The plurality of log lifting arms 38 may have a chain or belt that rotates around the arm portion of the log lifting arms 38 to move the log halves onto the receiving conveyor 42. In some embodiments, the log halves are moved onto a receiving table for hand transport to a remote location for further processing.

The sawmill 10 according to the disclosed embodiments has a number of distinct advantages over conventional sawmills used for halving a log. For example, the sawmill 10 has a rather small footprint compared to a conventional sawmill and thus requires a much smaller space for operation of the sawmill 10. Due to the design of the log positioning rig 18, it is easier for a user to position the central core 26 of the log in line with parallel movement of the band saw along axis 34 in order to saw a log segment 14 in half through the central core 26. Unlike the use of large circular saws, the sawmill according to the disclosure uses a band saw which is easier to maintain and change than a circular saw of the size needed to saw through log segments. The band saw blades are also less expensive than the circular saw blades. Also, the band saw provides a much smaller kerf than the circular saw thereby increasing the yield of usable boards from the log segment 14. The sawmill is easier to set up and uses much less horsepower (60 HP versus 250 HP) than a conventional sawmill. Computer control of the positioning and sawing operation is not required.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A sawmill for sawing a log segment in two through a central core thereof, comprising:

a band saw and a log positioning rig;

a log feed conveyor configured for feeding logs to the band saw and the log positioning rig, the band saw being disposed on a movable carriage of a fixed frame, the band saw being configured for sawing a log from a first end of the log to a distal end of the log, wherein the log positioning rig comprises a reciprocating cradle having a plurality of spaced-apart cradle segments, the reciprocating cradle being pivotally attached to the fixed frame, and being configured for raising or lowering the first end of the log to align the central core of the log along the length of the log with a blade of the saw; and wherein the fixed frame further comprises a plurality of spaced-apart log lifting arms disposed within the plurality of spaced-apart cradle segments.

2. The sawmill of claim 1, further comprising an actuator attached to a first end of the reciprocating cradle and to the fixed frame, the actuator being configured for raising or lowering the first end of the reciprocating cradle to center the central core of the log with the blade of the band saw.

3. The sawmill of claim 1, wherein the reciprocating cradle further comprises a plurality of spaced-apart mechanically operated stop arms disposed within the plurality of spaced-apart cradle segments.

4. The sawmill of claim 1, wherein the reciprocating cradle further comprises a plurality of spaced-apart dogs disposed within the spaced-apart cradle segments, the plurality of spaced-apart dogs being configured for holding the log segment during the sawing operation.

5. The sawmill of claim 4, further comprising a pneumatic or hydraulic operator for each of the plurality of spaced-apart dogs.

6. The sawmill of claim 1, wherein the fixed frame further comprises a shaft about which the reciprocating cradle pivots.

7. The sawmill of claim 1, wherein the plurality of spaced-apart log lifting arms are attached to a shaft configured for rotating conveyor chains on each of the plurality of spaced-apart lifting arms.

8. A method for sawing a log segment in half, the method comprising:

providing a sawmill for sawing a log segment in two through a central core thereof, the sawmill comprising: a log feed conveyor configured for feeding logs to a band saw and log positioning rig, the band saw being disposed on a movable carriage of a fixed frame, wherein the log positioning rig comprises a reciprocating cradle having a plurality of spaced-apart cradle segments, the reciprocating cradle being pivotally attached to the fixed frame, and being configured for raising or lowering a first end of the log to align the central core of the log along the length of the log with a blade of the band saw;

feeding a log segment to the reciprocating cradle from the log feed conveyor;

pivoting the reciprocating cradle to align the band saw to a center of a heart of the log from the first end of the log to a distal end of the log;

sawing the log segment in half from the first end of the log to a distal end of the log thereof by moving the band saw on the fixed frame from the first end of the log to the distal end of the log; and lifting and moving log halves from the reciprocating cradle to a receiving conveyor for further processing.

9. The method of claim 8, wherein the sawmill comprises a plurality of spaced-apart lifting arms within the plurality of space-apart cradle segments, the spaced-apart lifting arms being attached to a shaft, further comprising activating the lifting arms to center the log segment on the reciprocating cradle prior to the step of pivoting the reciprocating cradle.

10. The method of claim 9, wherein the step of lifting and moving the log halves from the reciprocating cradle to a receiving conveyor comprises activating the plurality of spaced-apart lifting arms.

11. The method of claim 10, wherein the log positioning rig comprises an actuator attached to a first end of the reciprocating cradle and to the fixed frame, wherein the pivoting step comprises activating the pneumatic actuator to raise or low the first end of the reciprocating cradle to center the central core of the log with the blade of the band saw prior to the sawing step.

12. The method of claim 10, wherein the reciprocating cradle comprises a plurality of spaced-apart dogs disposed within the spaced-apart cradle segments, further comprising activating the plurality of spaced-apart dogs to hold the log segment during the sawing step.

13. The method of claim 12, wherein each of the plurality of spaced-apart dogs are attached to a hydraulic or pneumatic operator, further comprising actuating the hydraulic or pneumatic operator for each of the plurality of spaced-apart dogs.

14. The method of claim 8, further comprising moving the band saw vertically to align the band saw with the central core of the log segment.

* * * * *